US008925341B2

(12) United States Patent
Benz et al.

(10) Patent No.: US 8,925,341 B2
(45) Date of Patent: Jan. 6, 2015

(54) ICE CUBE CONTAINER OF AN ICE MAKER FOR HOUSEHOLD PURPOSES, AND REFRIGERATION APPLIANCE COMPRISING SUCH AN ICE CUBE CONTAINER

(75) Inventors: Thomas Benz, Neu-Ulm (DE); Alexander Görz, Aalen (DE); James Jenkins, San Diego, CA (US); Matthew Ricket, Charlotte, NC (US)

(73) Assignee: BSH Bosch und Siemens Hausgerate GmbH, Munich (DE)

( * ) Notice: Subject to any disclaimer, the term of this patent is extended or adjusted under 35 U.S.C. 154(b) by 521 days.

(21) Appl. No.: 13/133,158

(22) PCT Filed: Nov. 13, 2009

(86) PCT No.: PCT/EP2009/065160

§ 371 (c)(1),
(2), (4) Date: Jun. 7, 2011

(87) PCT Pub. No.: WO2010/066538

PCT Pub. Date: Jun. 17, 2010

(65) Prior Publication Data

US 2011/0239688 A1 Oct. 6, 2011

(51) Int. Cl.

| | |
|---|---|
| ***F25C 5/18*** | (2006.01) |
| ***F25D 25/02*** | (2006.01) |
| *F25D 23/02* | (2006.01) |

(52) U.S. Cl.

CPC ..... *F25D 25/025* (2013.01); *F25C 5/182* (2013.01); *F25D 23/021* (2013.01)

USPC ..... 62/344; 62/449

(58) Field of Classification Search

CPC ..... F25C 1/00; F25C 5/182; F25D 25/025; F25D 23/021

USPC ..... 62/340, 344, 382, 449; 220/759, 761; 312/402, 404

See application file for complete search history.

(56) References Cited

U.S. PATENT DOCUMENTS 1,665,456 A * 4/1928 Andrew Hansson ..... 220/651
3,744,270 A * 7/1973 Wilcox ..... 62/344

(Continued)

FOREIGN PATENT DOCUMENTS

| | | |
|---|---|---|
| EP | 1788329 A2 | 5/2007 |
| EP | 1832823 A2 | 9/2007 |
| EP | 1850078 A2 | 10/2007 |

OTHER PUBLICATIONS

International Search Report PCT/EP2009/065160.

*Primary Examiner* — Mohammad M Ali
(74) *Attorney, Agent, or Firm* — Nixon & Vanderhye P.C.

(57) ABSTRACT

An ice cube container of an ice maker for household purposes includes a bottom, front and rear wall sections arranged on opposite ends of the bottom, and two sidewall sections interconnecting the end wall sections. The front and rear wall sections have each a length which is shorter than a length of the side wall sections. Arranged on one of the sidewall sections is a removal handle to allow easy removal of ice cubes. The ice cube container is removably received in a receptacle of a freezer compartment drawer of a refrigeration appliance in only one way in which the removal handle of the ice cube container faces the center of the freezer compartment drawer when the ice cube container is inserted in the receptacle.

34 Claims, 4 Drawing Sheets

(56) References Cited

U.S. PATENT DOCUMENTS

| | | | | |
|---|---|---|---|---|
| 4,789,130 | A * | 12/1988 | Stich et al. | 249/120 |
| 5,329,786 | A * | 7/1994 | Willis et al. | 62/353 |
| 6,253,568 | B1 * | 7/2001 | Peffley | 62/441 |
| 6,425,259 | B2 * | 7/2002 | Nelson et al. | 62/344 |
| 6,745,578 | B2 * | 6/2004 | Collins et al. | 62/71 |
| 7,406,833 | B2 * | 8/2008 | Ertz et al. | 62/115 |
| 7,469,553 | B2 * | 12/2008 | Wu et al. | 62/344 |
| 7,757,511 | B2 * | 7/2010 | LeClear et al. | 62/340 |
| 7,784,625 | B2 * | 8/2010 | Burgess et al. | 211/87.01 |
| 7,954,183 | B2 * | 6/2011 | Cawthon | 4/650 |
| 2001/0025505 | A1 | 10/2001 | Nelson et al. | |
| 2004/0183415 | A1 * | 9/2004 | Kim | 312/402 |
| 2005/0115266 | A1 * | 6/2005 | Lim et al. | 62/351 |
| 2006/0016211 | A1 | 1/2006 | Lyvers et al. | |
| 2006/0086132 | A1 * | 4/2006 | Maglinger et al. | 62/344 |
| 2007/0151281 | A1 * | 7/2007 | Jackovin | 62/344 |

* cited by examiner

ICE CUBE CONTAINER OF AN ICE MAKER FOR HOUSEHOLD PURPOSES, AND REFRIGERATION APPLIANCE COMPRISING SUCH AN ICE CUBE CONTAINER

BACKGROUND OF THE INVENTION

The present invention relates to an ice cube container of an ice cube maker for household purposes, having a bottom, a front and a rear short end wall section, two long side wall sections and a removal handle. The invention further relates to a refrigeration appliance, in particular for household purposes, comprising an ice cube maker having an ice cube container that can be withdrawn from the refrigeration appliance.

US 2001/0025505 A1 discloses an ice cube maker of a refrigeration appliance for household purposes. The ice cube maker disclosed therein has an ice cube container. On the ice cube container, a contoured handle and spout are molded onto the uppermost section of the short side wall. Handle and spout are used to lift the ice cube container up and to tip ice cubes out of the ice cube container. Both the short side wall and the handle have a convex shape, in order to engage comfortably with the hand surface of a user who lifts up or tilts the ice cube container. A second handle is formed by a cutout on a storage base of the ice cube container, said cutout being located under the side wall. The configuration of the two handles allows the user reliably to grasp and tilt the ice cube container from both sides, in order to tip ice cubes out of the ice cube container via the spout into a glass or other utensil. This means that both hands of a user are always required for simple removal of ice cubes from the ice cube container according to the prior art.

BRIEF SUMMARY OF THE INVENTION

The object of the invention is to provide an ice cube container of an ice cube maker for household purposes, and an associated refrigeration appliance from which the ice cubes can be removed more easily.

The object is achieved by an ice cube container of an ice cube maker for household purposes having the features in the independent claim 1 and by an associated refrigeration appliance having the features in the independent claim 8. Further embodiments of the invention are defined in the dependent claims.

By virtue of the removal handle being arranged on one of the long side wall sections, the ice cube container can be removed from its position (which is assigned to an ice cube maker) in a manner which is simpler or more convenient for the user, in order that a desired number of ice pieces can be served.

Depending on the desired contour shape of the ice piece, the shape can be variously developed. In particular, the shape can be shell-shaped, e.g. in the form of a hemisphere or a disc slice. Ice cubes are therefore understood to mean ice pieces of any shape, even if they do not actually have a cubic shape. In particular, the ice cube container is not exclusively suitable for holding cubic ice pieces. Rather, the ice cube container is intended for holding ice pieces of any shape.

In household appliances, an ice cube maker does not generally occupy the full width of the household appliance, but extends in its width over only part of the width of the household appliance. Due to the general depth of the household appliance and the desired space utilization, this has the consequence that an ice cube container assigned to the ice cube maker also has a greater depth and a lesser width. The short end wall sections of the ice cube container therefore correspond to the width of the ice cube container and the long side wall sections correspond to the depth of the ice cube container. The distinction between short end wall sections and long side wall sections relates to the different length ratio of end wall sections and side wall sections relative to each other. In other words, "short" in reference to the end wall sections merely means that these end wall sections are shorter than the side wall sections. In respect of the side wall sections, "long" means that the side wall sections are longer than the end wall sections.

A conventional household appliance having an ice cube maker is e.g. a refrigeration appliance with a freezer compartment. In such a refrigeration appliance, the ice cube container has a bottom, a short end wall section at front and rear, and two long side wall sections. In the operating position in which the ice cube container is situated in the refrigeration appliance, one of the two short end wall sections faces forwards, i.e. towards the door side of the refrigeration appliance. Previously, an ice cube container has always been equipped with a handle at the front in the manner of a drawer, i.e. facing towards the door side of the refrigeration appliance. Due to the depth of the ice cube container being greater than its width, this means that the handle is always far away from the center of gravity of the ice cube container (full of ice cubes) as a result of its structural location, assuming the ice cubes are loaded evenly. This has the disadvantage that the user requires considerable strength and effort to hold an ice cube container that has been removed.

By virtue of the removal handle being inventively arranged on one of the long side wall sections of the ice cube container, the removal handle is moved closer to the center of gravity of the ice cube container filled with ice cubes, and therefore the user can hold a removed ice cube container more easily and using less strength. This simplifies and improves operation by a user, since the ice cube container can be removed in a simpler i.e. more convenient manner. By virtue of the removal handle being moved closer to the center of gravity of the ice cube container filled with ice cubes, it is also possible for the user to serve ice pieces more easily and precisely, i.e. to tip out individual ice cubes into a glass or other container, e.g. via a spout or one of the corners of the ice cube container.

The removal handle can extend along the side wall section, in particular along most or all of the length of the side wall section. In this case, the extent of the removal handle can be considerably longer than the width of the hand of a user. The user can therefore grasp the removal handle at various positions. This allows the user, depending on the current distribution of ice cubes in the ice cube container, to grasp the removal handle at that position which is closest to the current center of gravity of the ice cube container filled with ice cubes. For example, if the majority of the ice cubes are predominantly located in the front half of the ice cube container due to a previous tipping activity, the user can grasp the removal handle at approximately the center of the front half in order to remove it. If the ice cubes are predominantly in the rear half of the ice cube container, e.g. due to an outlet opening of an ice cube maker being arranged further back, the user can grasp the removal handle at approximately the center of the rear half in order to remove it. If the ice cubes are distributed approximately evenly in the ice cube container, the user can grasp the removal handle centrally, i.e. at an equal distance from the front and rear end faces of the ice cube container, in order to remove it.

The removal handle can extend along the whole length of the side wall section, i.e. the removal handle runs from the front end wall to the rear end wall. This offers the greatest possible variation in width when the ice cube container is grasped by the hand of a user.

It is entirely sufficient and within the scope of the invention for the removal handle to extend along merely most of the length or a considerable partial length of the side wall section. It is thus entirely sufficient, though not optimal, for the removal handle to extend along e.g. merely two thirds or at least half of the total length of the side wall section of the ice cube container. The removal handle is preferably arranged centrally in this case. This maintains a largely comprehensive flexibility, allowing the user to grasp the ice cube container at various positions of the removal handle.

In all of the variants according to the invention, the removal handle can be embodied as a handle trough. The handle trough can be embodied a separate component, which is attached to one of the side wall sections of the ice cube container. The removal handle can also be designed as an integral part of the ice cube container. In this case, the handle trough can be formed in particular by shaping the side wall section of the ice cube container. In this case, the handle trough is essentially formed by shaping the side wall of the ice cube container approximately into a C-shape in cross section. In an upper region, the handle trough forms an undercut into which the fingers of a hand of the user can engage. The balls of the hands or the thumbs of the user can be placed on an outside of a top wall section which projects over the undercut. This allows the user to grasp the ice cube container in a manner which is intuitive, secure and ergonomic. The handle trough also offers a secure hold which requires little strength when turning or tilting the ice cube container in order to tip ice cubes out.

Such a handle trough can therefore have a lateral engagement opening and be embodied so as to have an undercut recess on the top side. The handle trough can be formed by means of an inwardly extending indentation of the side wall section. The indentation is formed by an inwardly extending shaping of the side wall section of the ice cube container.

In all of the embodiments, the handle trough can have a radius of curvature which decreases in cross section from a lower end to an upper end of the handle trough. In this way, the side wall of the ice cube container does not have a mirror-symmetrical C-shape in cross section. The C-shape in this variant is instead a spiral-type curvature. This shape firstly ensures a widest possible engagement opening for easy and intuitive engagement into the handle trough by the fingers of the hand of a user. Secondly, the ends of the fingers in the undercut recess which has a small radius of curvature on the top side of the handle trough are reliably and closely surrounded such that the fingers are placed securely and cannot slip.

The handle trough can be embodied in particular in the form of a groove extending along the side wall section and be closed at the end. By virtue of the handle trough extending in the form of a groove along the side wall section, the hand of the user can be placed in the handle trough at any desired position of the side wall extent. This also allows the user, depending on the current distribution of ice cubes in the ice cube container, to grasp the removal handle at that position which is closest to the current center of gravity of the ice cube container filled with ice cubes. By virtue of a design which is closed at the end, a hand which is inserted into the handle trough is prevented from sliding sideways out of the groove i.e. at the end of the ice cube container. The end faces of the groove can be formed by wall sections of the ice cube container.

The invention also relates to a refrigeration appliance, in particular for household purposes, comprising an ice cube maker which has an ice cube container that can be withdrawn from the refrigeration appliance, in particular according to one of the variants described above. The refrigeration appliance for household purposes can have a freezer compartment in which, in addition to shelves for frozen foods, provision is also made for a device for producing ice cubes, i.e. an ice cube maker. In order that ice cubes can be produced continuously in sufficient quantity, a plurality of ice cubes are usually produced as a batch by the ice cube maker, and the batch of ice cubes that has been generated in each case is output into an ice cube container and stored there temporarily until it is removed by the user in a desired quantity from the ice cube container. The ice cube container can therefore temporarily store a plurality of batches of ice cubes that have been generated. The ice cube container can be stored in the refrigeration appliance in such a way that it can be removed from the freezer compartment.

A refrigeration appliance according to the invention can have a pull-out freezer compartment drawer which has a receptacle for a removable ice cube container in accordance with one of the variants of the ice cube container described above. The freezer compartment drawer can have the form of a trough-shaped insert which forms a shelf for frozen foods. The trough-shaped insert can have grid-type side walls and a grid-type floor surface. The freezer compartment drawer can have mounting bars which rest on guide rails in the freezer compartment, such that the freezer compartment drawer can be withdrawn from the freezer compartment and pushed into the freezer compartment. In order that it can be moved, the freezer compartment drawer can have a handle. The handle can be formed by an aperture in a front side wall of the trough-shaped freezer compartment drawer. The freezer compartment drawer is not only used for holding frozen foods, but also for holding the ice cube container according to the invention. For this purpose, the trough-shaped freezer compartment drawer can have a separate region, which is adapted in its contour to the size and shape of the ice cube container. The ice cube container can therefore be placed in the correct position in the freezer compartment drawer. By virtue of the separate region, the ice cube container is held securely in place in the freezer compartment drawer, such that the ice cube container itself cannot slip if the freezer compartment drawer is pulled out or pushed in forcefully.

In particular, in such a refrigeration appliance, the receptacle for correct positioning of the ice cube container can be embodied in a shape or contour which corresponds to the ice cube container, and be so oriented in the freezer compartment drawer that, when the ice cube container is inserted in the receptacle, its removal handle faces towards the center of the freezer compartment drawer.

The ice cube container according to the invention can belong to an ice cube maker which is arranged in a freezer compartment on the bottom side of a fridge-freezer of a household refrigeration appliance. By virtue of the ice cube container according to the invention, the ice cube container can be withdrawn and replaced easily. For this purpose, the ice cube container has the longitudinally extending lateral removal handle according to the invention. This laterally arranged removal handle eliminates undesirable dead space which would be required in the case of a front handle in order to allow the ice cube container to be removed from the front of a freezer compartment drawer, for example. This also increases the useful space for other frozen foods in the freezer compartment drawer. The ice cube container according to the invention therefore also offers a larger useful volume, such that a larger quantity of ice cubes can be contained and, with the ice cube container, can be transferred or transported by the user. The ice cube container according to the invention additionally has two gaps which make space for an ice cube maker or an ice cube dispenser which is arranged above the ice cube container. Due to their curved or rolled rim structure, the gaps can also be used as additional handles.

BRIEF DESCRIPTION OF THE DRAWINGS

An embodiment of the invention is described with reference to an ice cube container in a refrigeration appliance for household purposes, which is illustrated in the figures by way of example. Further general features and advantages of the present invention can also be derived from the detailed description of the specific exemplary embodiment.

DETAILED DESCRIPTION OF EXEMPLARY EMBODIMENTS OF THE PRESENT INVENTION

Figure 1:
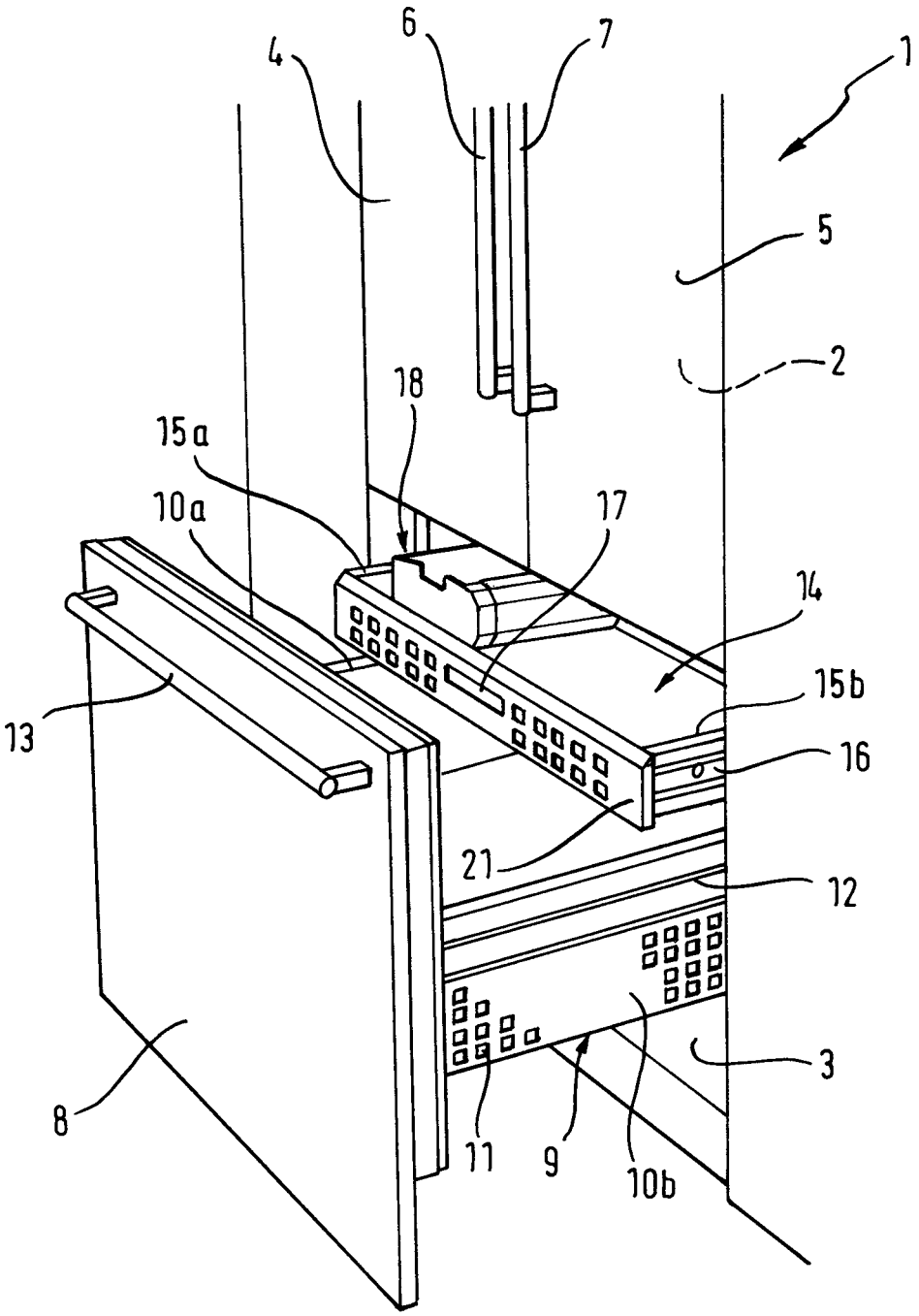
FIG. 1 shows a perspective view of a freezer part of a refrigeration appliance for household purposes, comprising an ice cube container according to the invention.

A refrigeration appliance 1 according to FIG. 1 has an upper refrigerator compartment 2 and a lower freezer compartment 3. The upper refrigerator compartment 2 can be closed by a left-hand door 4 which is pivotably mounted on the refrigeration appliance 1 and a right-hand door 5 which is pivotably mounted on the refrigeration appliance 1. For the purpose of swinging the left-hand door 4 open and closed, a first vertically oriented handle 6 is arranged on the front side thereof. For the purpose of swinging the right-hand door 5 open and closed, a second vertically oriented handle 7 is arranged on the front side thereof. The two handles 6 and 7 are rod-shaped and extend in a vertical direction. The rod-shaped handles 6 and 7 are connected at an upper and lower end in each case to the associated front side of the left-hand door 4 or right-hand door 5 respectively. The doors 4 and 5 are swung open by pulling on the rod-shaped handles 6 and 7 towards the body of the user, thereby allowing access to the interior of the refrigerator compartment 2. Below the refrigerator compartment 2, the refrigeration appliance 1 has the freezer compartment 3. The freezer compartment 3 can be closed by a lower door 8, which can be pulled out translationally in the manner of a drawer front, in order to allow access to the interior of the freezer compartment 3. For this purpose, the door 8 in the form of a drawer front is fastened to a forward end face of a pull-out freezer basket 9. The freezer basket 9 is embodied in the form of a trough and has side walls 10*a*, 10*b* with rectangular perforation 11. Each of the two side walls 10*a*, 10*b* of the freezer basket 9 bears a first guide rail 12. The freezer basket 9 can be pulled out forwards in a linear direction by means of the first guide rails 12 in the manner of a drawer. For the purpose of pulling out the freezer basket 9, the door 8 has a horizontal handle 13 on its outside. The handle 13 is embodied in the form of a rod in a similar manner to the handles 6 and 7, but extends in a horizontal direction along its length. By pulling the rod-shaped horizontal handle 13 towards the body of the user, the freezer basket 9 is pulled out forwards in the manner of a drawer. A freezer compartment drawer 14 is arranged above the freezer basket 9 and yet within the freezer compartment 3. The freezer compartment drawer 14 can be pulled out forwards in the same way as the freezer basket 9 in a linear movement in the manner of a drawer. To this end, the freezer compartment drawer 14 has two opposing side walls 15*a*, 15*b*, each of which bears a second guide rail 16. The freezer compartment drawer 14 can be pulled out forwards in a linear direction by means of the second guide rails 16 in the manner of a drawer. For the purpose of pulling out the freezer compartment drawer 14, this has on its front end wall 21 an engagement opening 17 for the fingers of a hand of a user. The freezer compartment drawer 14 is embodied in the form of a trough. The freezer compartment drawer 14 accommodates the ice cube container 18 according to the invention.

Figure 2:
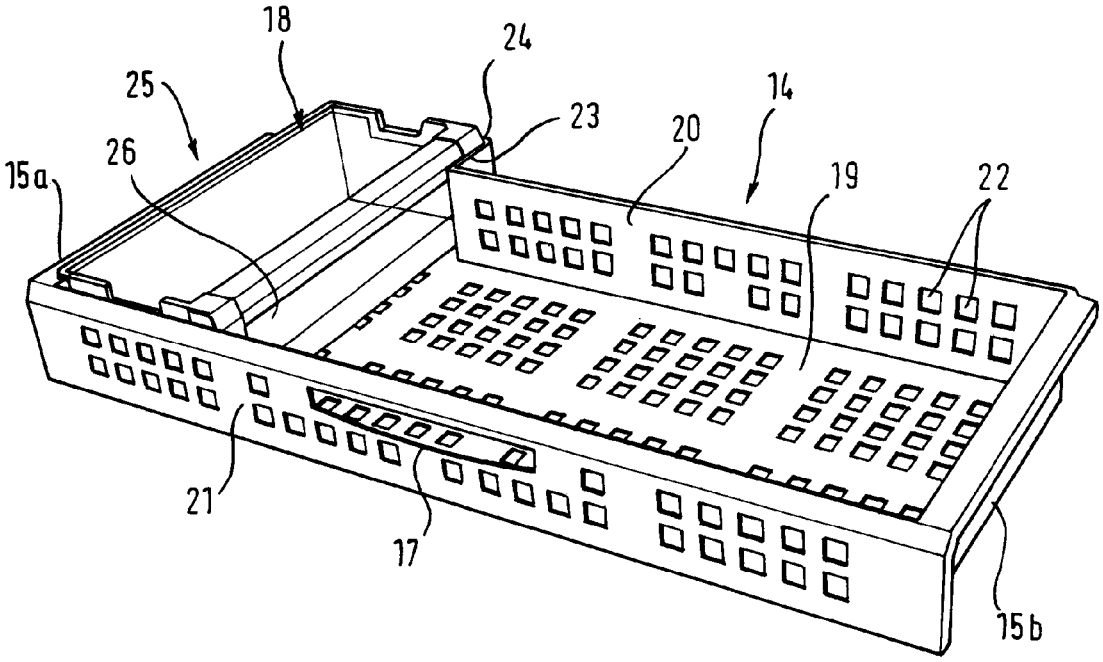
FIG. 2 shows a perspective view of a freezer compartment drawer, comprising an inserted ice cube container according to the invention.

The freezer compartment drawer 14 comprising the ice cube container 18 according to the invention is shown individually in FIG. 2. The freezer compartment drawer 14 has a grid floor 19, a left-hand side wall 15*a* and a right-hand side wall 15*b*, and a rear wall 20 and a front end wall 21. The grid floor 19, the rear wall 20 and the front wall 21 all have openings 22. The openings 22 have a square contour and are arranged uniformly in rows and columns, thereby forming a grid-type structure. In a central region and offset upwards to some extent, the front end wall 21 has the engagement opening 17 for the fingers of a hand of a user. The rear wall 20 is embodied such as to be stepped in a region that is oriented towards the left-hand side wall 15*a*. In other words, the depth of the freezer compartment drawer 14 going backwards from the plane of the drawing in FIG. 2 is greater in the region of the left-hand side wall 15*a* than the depth of the remaining freezer compartment drawer 14. The greater depth of the freezer compartment drawer 14 is adapted in its width to the width of the ice cube container 18 that is inserted. As a result of the step 23 that is formed in the rear wall 20, the ice cube container 18 is therefore held with a positive fit. Any rightward slippage of the ice cube container 18 towards the center of the freezer compartment drawer 14 is therefore reliably prevented. The deeper section 24 of the rear wall 20, the left-hand side wall 15*a* and a left-hand part of the front wall 21, with the grid floor 19 form a receptacle 25 for the ice cube container 18. The receptacle 25 is therefore embodied to have a shape or contour which corresponds to the ice cube container 18, i.e. the ice cube container 18 is properly held with positive fit in the receptacle. The ice cube container 18 has a removal handle 26. The removal handle 26 is oriented towards that part of the freezer compartment drawer 14 which is not formed by the receptacle 25, but forms the remaining storage region 27 for other frozen foods. In other words, due to its lateral position in the freezer compartment drawer 14, the removal handle 26 is arranged facing (i.e. oriented towards) the center of the freezer compartment drawer 14. Consequently, the removal handle 26 can be grasped by a hand of a user from the direction of the free center of the freezer compartment drawer 14. In particular, the ice cube container 18 can be grasped in a center of its longitudinal side in this case, i.e. in one of its long side wall sections 28, and removed from the freezer compartment drawer 14.

Figure 3:
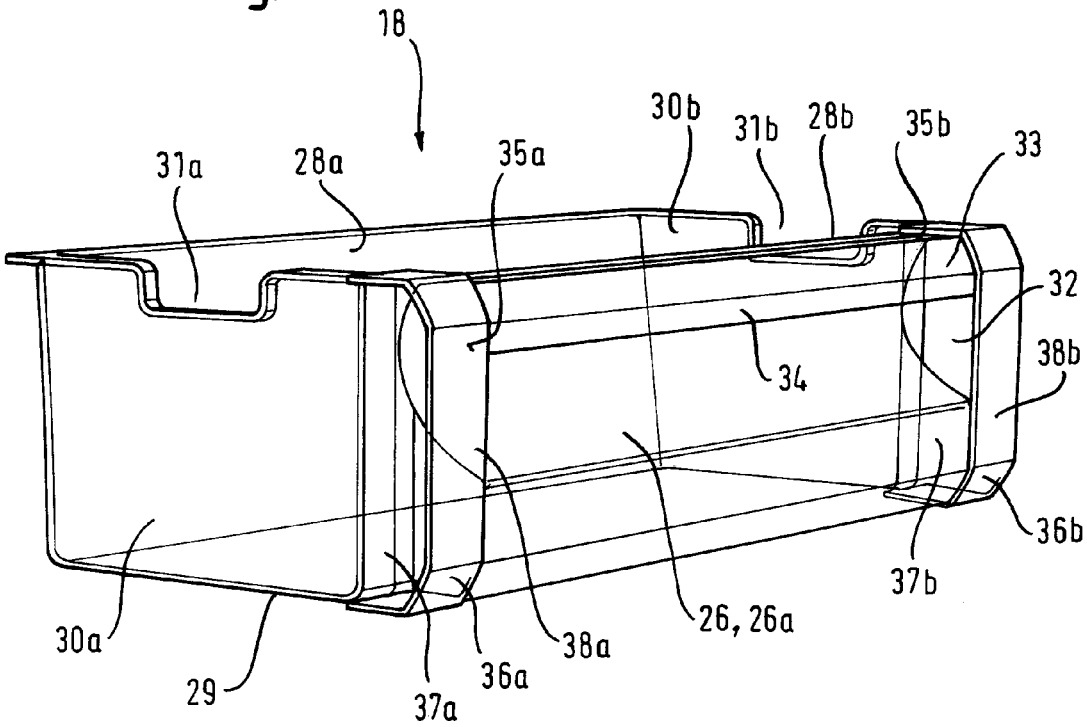
FIG. 3 shows a perspective view of the ice cube container according to FIG. 2.

A detailed structural embodiment of the ice cube container 18 is shown individually in FIG. 3. The ice cube container 18 has a cuboid shape and is embodied in the manner of a trough. To this end, the ice cube container 18 has an at least approximately rectangular bottom 29, two short side wall sections 30*a*, 30*b* and two long side wall sections 28*a*, 28*b*. Both the two short side wall sections 30*a*, 30*b* and the two long side wall sections 28*a*, 28*b* are arranged respectively at opposite ends of the preferably rectangular bottom 29 and extend upwards in an essentially vertical manner. The two short side wall sections 30*a*, 30*b* and the two long side wall sections 28*a*, 28*b* are oriented on parallel planes in each case. In FIG. 3, the front short side wall section 30*a* is shown in the foreground and the rear side wall section 30*b* is shown partly hidden in the background. A gap 31*a*, 31*b* is provided in each case at the relevant top end of the short side wall sections 30*a*, 30*b*. The gaps 31*a*, 31*b* provide space for an ice cube maker (not shown) which is arranged above the ice cube container 18. The gaps 31*a*, 31*b* can also be used as additional handles by virtue of their curved or rolled rim structure. The first long side wall section 28*a* is partially hidden in the background in FIG. 3 and the second long side wall section 28*b*, which has the removal handle 26, is shown in the foreground of FIG. 3 facing towards the right. The bottom 29 with the two short side wall sections 30*a*, 30*b* and the two long side wall sections 28*a*, 28*b* can be manufactured as an integral plastic injection-molded part. In particular, the ice cube container 18 can consist of a transparent plastic. The removal handle 26 is embodied as a handle trough 26*a* in the illustrated exemplary embodiment.

The handle trough 26*a* extends from the front short side wall section 30*a* in the foreground of FIG. 3 to the rear side wall section 30*b* in the background. The handle trough 26*a* has the shape of a groove, i.e. the handle trough 26*a* has a lateral engagement opening 32 which extends longitudinally. In this respect, the handle trough 26*a* is formed as an indentation of the long side wall section 28*b*. In this respect, the engagement opening 32 forms an elongated rectangular window by means of which the fingers of a hand of a user can be introduced into the handle trough 26*a*. The handle trough is embodied to include a recess 33 on the top side, i.e. towards the top. In this respect, the recess 33 is formed by a wall section 34 of the handle trough 26*a*, wherein said wall section 34 projects forwards and downwards. The projecting wall section 34 forms the undercut recess 33 in which, in particular, the fingertips of the hand of the user are placed when grasping the ice cube container 18. By virtue of the grooved shape, it is possible to engage with the handle trough 26*a* at various positions of the removal handle 26. Depending on the length of the groove-shaped handle trough 26*a*, greater or lesser variability is provided for the engagement of the fingers. Even assuming the widest possible embodiment, i.e. the greatest possible length of the handle trough 26*a*, a rib-shaped edge terminator 36*a*, 36*b* can be provided at each of the opposing end faces 35*a*, 35*b* of the handle trough 26*a* as illustrated in FIG. 3. Each edge terminator 36*a*, 36*b* is formed from one of the terminating walls 37*a*, 37*b*, these being offset in a stepped manner relative to the plane of the front and rear short end wall sections 30*a*, 30*b*, i.e. reciprocally offset. A C-shaped surrounding collar 38*a*, 38*b* is molded onto the terminating walls 37*a*, 37*b* in each case. By means of the two opposing collars 38*a*, 38*b*, the ice cube container 18 can also be gripped from both sides with two hands when in a position that is removed from the freezer compartment drawer 14, e.g. in order to facilitate cleaning of the ice cube container 18. In this respect, additional handle troughs are created by one of the terminating walls 37*a* 37*b* and one of the collars 38*a*, 38*b* in each case.

Figure 4:
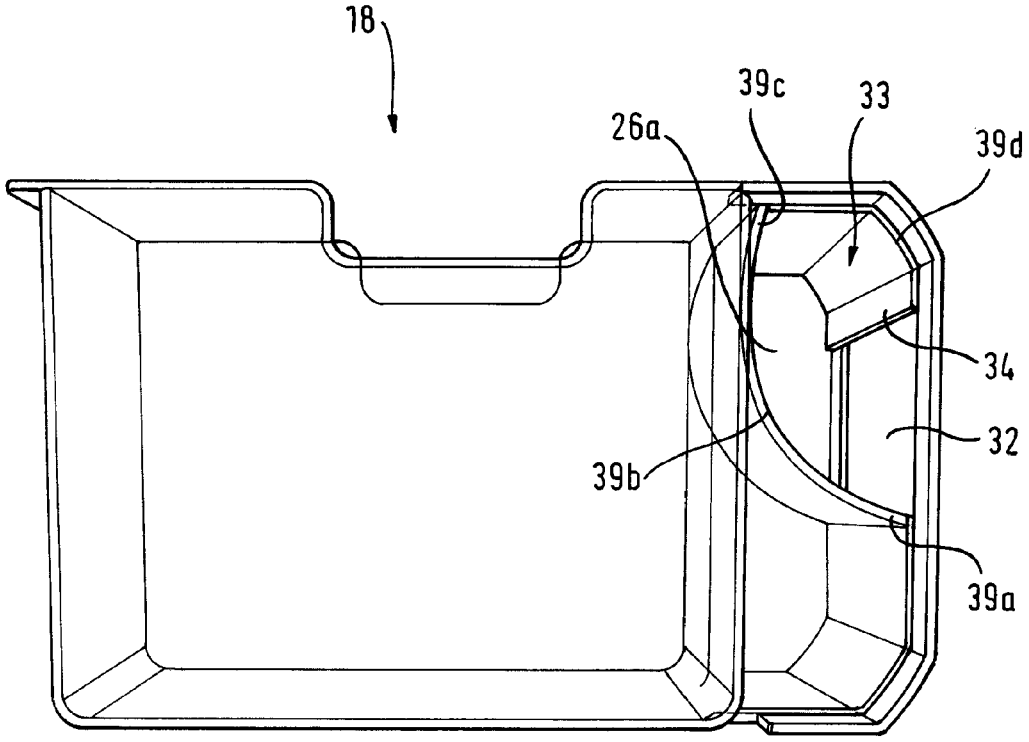
FIG. 4 shows an end-face plan view of the ice cube container according to FIG. 3.

The structure of the groove-shaped handle trough 26*a* is shown more clearly in FIG. 4. The indented wall of the handle trough 26*a* begins approximately below the midway height of the long side wall section 28*b* of the ice cube container 18. A first trough section 39*a* initially extends almost horizontally, i.e. orthogonally relative to the vertical long side wall section 28*b*, and then merges continuously into a second trough section 39*b*, which climbs upwards with a large radius of curvature and, in a third trough section 39*c* having decreasing radius of curvature, merges into an overhanging fourth trough section 39*d*, which forms the recess 33 that is undercut on the top side, i.e. the top wall section.

The invention claimed is:

1. An ice cube container of a household refrigeration appliance ice cube maker, said ice cube container comprising:

a bottom;

front and rear end wall sections arranged on opposite ends of the bottom, each of the end wall sections being defined by a length;

two side wall sections interconnecting the end wall sections, each of the side wall sections being defined by a length which is greater than the length of the end wall sections; and an elongated removal handle with an undercut arranged on one of the side wall sections, the undercut being configured to receive a user's hand at different graspable positions along the one of the side walls, wherein the ice cube container is configured to be removable from the refrigeration appliance by way of a single hand of a user grasping the ice cube container at one of the graspable positions.

2. The ice cube container of claim 1, wherein the removal handle extends along a major part of the one of the side wall sections.

3. The ice cube container of claim 1, wherein the removal handle extends along an entire length of the one of the side wall sections.

4. The ice cube container of claim 1, wherein the removal handle is configured in the form of a handle trough.

5. The ice cube container of claim 4, wherein the handle trough has a lateral engagement opening and the undercut defines a recess on a top side of the handle trough.

6. The ice cube container of claim 4, wherein the handle trough is formed by an inwardly projecting indentation of the one of the side wall sections.

7. The ice cube container of claim 4, wherein the handle trough has a radius of curvature which decreases in cross section from a lower end to an upper end of the handle trough.

8. The ice cube container of claim 4, wherein the handle trough is configured in the form of a groove extending along the one of the side wall sections and closed at an end thereof.

9. The ice cube container of claim 1, wherein the removal handle is positioned on a portion of one of the side wall sections so that the removal handle is proximate to a center of gravity of the ice cube container.

10. The ice cube container of claim 9, wherein the ice cube container is configured to be received by a freezer compartment of a refrigeration appliance so that the front end wall section faces a door of a freezer compartment or a front of a freezer compartment drawer.

11. The ice cube container of claim 10, wherein the ice cube container is configured to be received in a freezer compartment drawer and the side wall sections extend an entire depth of the freezer compartment drawer.

12. The ice cube container of claim 1, wherein the removal handle is configured to receive a hand of a user so that the ice cube container is supportable by only the user's hand at the removal handle.

13. The ice cube container of claim 1, wherein the undercut comprises an overhang structure with a horizontal portion and a vertical portion extending downward from the horizontal portion.

14. The ice cube container of claim 1, wherein the channel is closed at a lateral end to prevent a user's hand from sliding out of the channel.

15. A refrigeration appliance, comprising an ice cube maker having an ice cube container, said ice cube container comprising:

a bottom, front and rear end wall sections arranged on opposite ends of the bottom, each of the end wall sections being defined by a length, two side wall sections interconnecting the end wall sections, each of the side wall sections being defined by a length which is greater than the length of the end wall sections, and an elongated removal handle with an undercut arranged on one of the side wall sections, the undercut being configured to receive a user's hand and permit movement of a user's hand along the one of the side wall sections to accommodate shifting of a center of gravity of the ice cube container due to an unbalanced load of ice cubes, wherein the ice cube container is configured to be removable from the refrigeration appliance by way of a single hand of a user grasping the removal handle.

16. The refrigeration appliance of claim 15, constructed for household use.

17. The refrigeration appliance of claim 15, further comprising a pull-out freezer compartment drawer which has a receptacle for receiving the removable ice cube container.

18. The refrigeration appliance of claim 17, wherein the receptacle has a shape or contour which corresponds to a shape or contour of the ice cube container for correct positioning of the ice cube container, said receptacle being oriented in the freezer compartment drawer such that the removal handle of the ice cube container projects from the one of the side wall sections towards a center of the freezer compartment drawer, when the ice cube container is inserted in the receptacle.

19. The refrigeration appliance of claim 17, wherein a distance between a front wall and a rear wall of the pull-out freezer compartment drawer is greater at the receptacle than at other portions of the pull-out freezer compartment drawer.

20. The refrigeration appliance of claim 19, wherein the length of the side wall sections of the ice cube container is greater than the distance between the front wall and the rear wall of the pull-out freezer compartment drawer at the second portion of the continuous space.

21. The refrigeration appliance of claim 20, wherein the length of the side wall sections of the ice cube container is substantially the same as the distance between the front wall and the rear wall of the pull-out freezer compartment drawer at the first portion of the continuous space.

22. The refrigeration appliance of claim 21, wherein a width of the first portion of the continuous space is substantially the same as the length of the end wall sections of the ice cube container.

23. The refrigeration appliance of claim 15, wherein the channel is closed at one end to prevent the user's hand from sliding out of the channel.

24. A refrigeration appliance comprising:

a freezer compartment with a freezer compartment drawer;

an ice cube maker located within the freezer compartment; and an ice cube container adapted to be received by the freezer compartment drawer, the ice cube container comprising:

opposing front and rear end wall sections;

opposing side wall sections interconnecting the end wall sections, the side wall sections being longer than the end wall sections; and a removal handle arranged on one of the side wall sections so that the removal handle is proximate to a center of gravity of the ice cube container, wherein the freezer compartment drawer defines a continuous space, the freezer compartment drawer being shaped so that the ice cube container is receivable by a first portion of the continuous space when the ice cube container is in a predetermined position in which the opposing front and rear wall sections of the ice container face front and rear walls of the freezer compartment drawer and ice cube container is not receivable by a second portion of the continuous space when the ice cube container is in the predetermined position.

25. The refrigeration appliance of claim 24, wherein the removal handle is arranged to be centered on a location on the side wall section closest to the center of gravity of an empty ice cube container.

26. The refrigeration appliance of claim 25, wherein a depth of the first portion of the continuous space is greater than a depth of the second portion of the continuous space.

27. The refrigeration appliance of claim 26, wherein, when received by the freezer compartment drawer, the front end wall section of the ice cube container faces a front of the freezer compartment.

28. The refrigeration appliance of claim 27, wherein the side wall sections extend the entire depth of the freezer compartment drawer receptacle.

29. The refrigeration appliance of claim 24, wherein the pull-out freezer compartment drawer is configured to prevent the ice cube container from sliding toward the center of the pull-out freezer compartment drawer when the ice cube container is in the first portion of the continuous space.

30. The refrigeration appliance of claim 29, wherein a wall of the pull-out freezer compartment drawer prevents the ice cube container from sliding toward the center of the pull-out freezer compartment drawer when the ice cube container is in the first continuous space.

31. The refrigeration appliance of claim 24, wherein the ice cube container is configured to be supported by only a user's hand at the removal handle.

32. The refrigeration appliance of claim 24, wherein the removal handle is elongated to permit movement of a user's hand that accommodates shifting of the center of gravity due to an unbalanced load of ice cubes.

33. The refrigeration appliance of claim 24, wherein the first portion of the continuous space is defined by a first side wall of the freezer compartment drawer and the front and rear walls of the freezer compartment drawer, and the second portion of the continuous space is defined by a second side wall of the freezer compartment drawer and the front and rear walls of the freezer compartment drawer, the first and second side walls of the freezer compartment drawer opposing each other.

34. The refrigeration appliance of claim 33, wherein the first side wall of the freezer compartment drawer is longer than the second side wall of the freezer compartment drawer.

* * * * *